United States Patent [19]

Cook

[11] Patent Number: 4,782,983

[45] Date of Patent: Nov. 8, 1988

[54] DISPENSING PACKAGE WITH RUNOUT SIGNAL

[75] Inventor: Calvin S. Cook, Erie, Pa.

[73] Assignee: The Procter & Gamble Company, Cincinnati, Ohio

[21] Appl. No.: 108,680

[22] Filed: Oct. 15, 1987

[51] Int. Cl.[4] ..... B67D 5/22

[52] U.S. Cl. ..... 222/45; 222/49; 222/386; 222/390; 116/307; 401/194

[58] Field of Search ..... 222/23, 41, 45, 46, 222/47, 49, 386, 390, 508, 509, 519, 520, 522, 523, 525; 116/282, 306, 307; 401/171–176, 194, 141, 142; 221/6

[56] References Cited

U.S. PATENT DOCUMENTS

| | | | |
|---|---|---|---|
| 1,485,022 | 2/1924 | Fesler | 222/390 |
| 2,284,218 | 5/1942 | Livingston | 222/49 |
| 2,430,718 | 11/1947 | Jacobson | 222/386 |
| 2,816,309 | 12/1957 | Worth et al. | 222/390 X |
| 3,176,595 | 4/1965 | Schwartz | 222/386 X |
| 3,184,120 | 5/1965 | Undi | 222/49 X |
| 3,185,345 | 5/1965 | Hunegs | 222/45 |

*Primary Examiner*—Kevin P. Shaver

*Attorney, Agent, or Firm*—R. C. Witte; J. H. Gorman; L. L. Huston

[57] ABSTRACT

A dispensing package for cosmetic cream products which automatically and progressively indicates when the product has nearly been depleted by the user. The package includes a deformable fin cantilevered from the piston which contacts the underside of the wall on which applicating surface is formed and is thereby bent in the direction of an orifice in the applicating surface. Further advance of the piston causes the fin to progressively cross the orifice, becoming visible from the exterior. As the piston is further advanced towards the applicating surface, continued deformation of the fin causes it to advance fully across the orifice, thereby indicating to the user that the cream product is nearly depleted. The invention is well suited to dispensing packages which contain and dispense cream deodorants and antiperspirants.

6 Claims, 1 Drawing Sheet

DISPENSING PACKAGE WITH RUNOUT SIGNAL

FIELD OF THE INVENTION

This invention relates to a dispensing package for cream products and, more particularly, to packages used to apply cream deodorants or antiperspirants to the underarm.

BACKGROUND OF THE INVENTION

The type of dispensing package discussed herein is widely used to dispense thick cosmetic cream products to the axillae of the user. The product is extruded through one or more orifices in an applicating surface and then rubbed onto the axillae. As used herein a cosmetic cream product has a Stevens Texture Analyzer Penetration Number of 50 to 350 grams and a yield pressure of 4 to 20 grams per square centimeter as measured on a viscometer as being the highest point of a shear stress versus shear rate curve. Such dispensing packages usually have a charge of this cream product which is relatively small in comparison to the total weight of the package so the user may not realize, based upon the change in weight of the dispensing package as the product is used, when the contents have been depleted. Furthermore, the viscosity of the product prevents it from indicating when the user shakes the package, that the cream product is near depletion. Therefore, the user may unexpectedly run out of cream product and be inconvenienced by not having another package of the cosmetic product available.

One approach to this problem is given by U.S. Pat. No. 2,284,218, which issued May 26, 1942 to Livingston, wherein a projection affixed to the piston of the dispensing package protrudes through the orifice used to dispense the cream product as the elevator approaches this orifice. A projection which protrudes through the orifice may not allow ample time for the user to acquire another package of the product, since the product is exhausted by the time the signal becomes apparent. Furthermore, if the cream product is applied to the surface by contact of the applicating surface of the dispensing package with the surface, a protrusion on the dispensing package will interfere with effective application, particularly when the cream product is applied to the sensitive axilla area of the body.

It is an object of this invention to obviate the aforementioned problems related to providing indication to the consumer when the product contained within the dispensing package is nearly depleted.

It is also an object of this invention to provide a dispensing package which is easy to use, inexpensive to manufacture, and automatically provides an indication of the amount of product remaining in the dispensing package, when the product is nearly depleted.

In accordance with one aspect of the present invention there is provided a dispensing package for cream products having an interior product chamber of generally uniform cross section. The outer end of the product chamber is defined by a wall which closes the chamber and has an applicating surface to apply the product by contact. Located in the wall is an orifice which communicates with the product chamber. The bottom of the interior chamber is defined by an piston mounted generally perpendicular to the axis of the chamber and, which can move axially within the chamber, but not rotate. The periphery of the piston is generally congruent to the cross section of the interior chamber. Cantilevered from the piston is a flexible fin which is adapted to be deflected towards the orifice by means within the dispensing package. The fin will progressively move across the orifice as the piston is advanced.

BRIEF DESCRIPTION OF THE DRAWINGS

While the specification concludes with claims particularly pointing out and distinctly claiming the present invention, it is believed that the same will be better understood from the following description taken in conjunction with the accompanying drawings wherein like parts will be given the same reference number in the different figures.

DETAILED DESCRIPTION OF THE INVENTION

Figure 1:
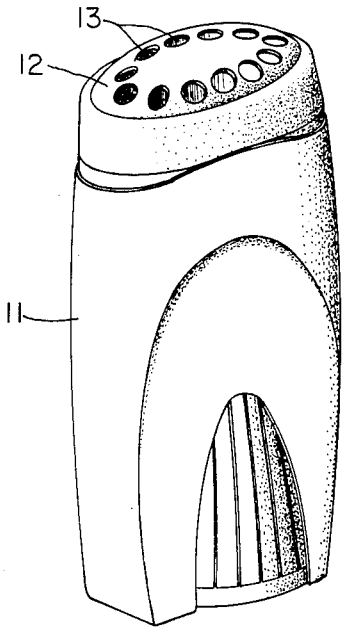
FIG. 1 is a perspective view of one embodiment of the dispensing package of the present invention.

The dispensing package, as illustrated in FIG. 1, has a body 11 preferably made of injection molded polypropylene or other suitable material. The size should allow the dispenser to be conveniently held by the user, yet large enough to accommodate the internal components discussed below and the desired charge of the cream product to be dispensed. The dispenser body 11 must also be sturdy enough to provide a frame to hold the components discussed below in the described relationship.

When the body 11 is held in the normal or upright position, the axis of the body 11 is vertical as illustrated by FIG. 1. At the top of the body 11 is an applicating surface 12 which is on a wall 9 closing the outer end of the body. This wall serves two functions. First, if the cream product is dispensed by contact with the surface to which it is applied, the applicating surface 12 provides for a uniform distribution of the product without an excessive or wasteful amount being applied. Also, the surface protects the product from external contamination when the dispenser is not in use.

The applicating surface 12 may be generally flat, arcuate or any shape judged advantageous for applying the product. The wall forming the applicating surface 12 should be approximately 1.4 to 1.7 mm (0.055 to 0.065 inches) thick to provide sufficient rigidity. The arcuate shape has a compound curvature with radii of approximately 21 mm (0.84 inches) and 5.75 cm (2.265 inches) to conform to the axilla area. The wall is preferably made of injection molded polypropylene.

The applicating surface 12 has one or more orifices 13 positioned therein which allow the product to flow from an interior product chamber 10 to the desired surface. The size, number, and distribution of the orifices 13 must be considered along with the shape of the applicating surface 12 and material properties of the cream product being dispensed to insure proper application will result. Twelve orifices 13 having a diameter of 4.3 mm (0.170 inches) distributed across the applicating surface 12 has been shown to yield an even layer of the cream product upon contact with the axilla.

Figure 2:
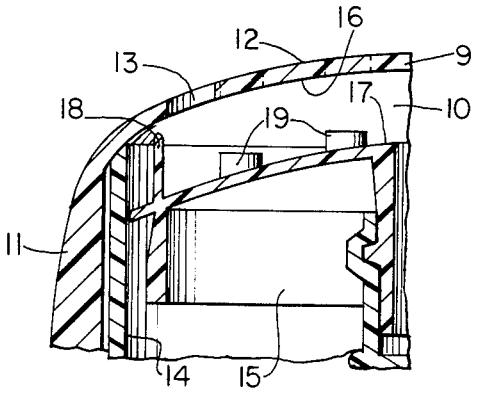
FIG. 2 is an enlarged fragmentary vertical cross-sectional view of the package of FIG. 1 showing an piston therein having an integral fin in a vertical position as it approaches the underside of the wall on which the applicating surface is formed.

As shown in FIG. 2, below the applicating surface 12 the product is held in an interior chamber 10. The sides 14 of the chamber 10 may be formed by the interior surface of the container body 11, eliminating the need for additional material, or can be a separate cavity within the body. The bottom of the chamber 10 is defined by the position of an piston 15 as it moves towards the applicating surface 12. It is important to prevent leakage of the product from the interior chamber, prior to the first use of the dispenser and between subsequent usages. Therefore, seals should be provided at the junctures between the sides 14 of the interior chamber and the underside 16 of the wall 9 on which applicating surface 12 is formed and between the sides 14 of the interior chamber 10 and the piston 15. If any other seams or leakage paths are present as a result of the manufacturing process, seals should also be provided at these locations.

The piston 15 is axially advanced toward the applicating surface 12, by any suitable drive means, causing the cream product contained by the interior chamber 10 to be extruded through the orifices 13 onto the applicating surface 12.

If the total weight of the cream product to be dispensed is small, the user may not sense when the product is nearly depleted. To assist the user in recognizing when this occurs, an externally visible signal indicating the position of the piston 15 with respect to the applicating surface 12 can be used. As shown in FIG. 2 an integrally formed upward extending flexible fin 18 may be cantilevered vertically from the top surface 17 of the piston 15 to provide the signal. The piston 15 and fin 18 are preferably made of homopolymer polypropylene, by standard injection molding techniques. The fin 18 should be approximately 7.1 mm (0.281 inches) in the axial dimension, 0.5 mm (0.020 inches) thick, and 5.1 mm (0.200 inches) wide to ensure proper deflection and resiliency will result. An piston 15 having a cross-sectional area of approximately 11 square centimeters (1.7 square inches) is satisfactory. The fin 18 and piston 15 are preferentially molded as a unit, eliminating the need for a separate means to attach the fin 18 to the piston 15.

Figure 3:
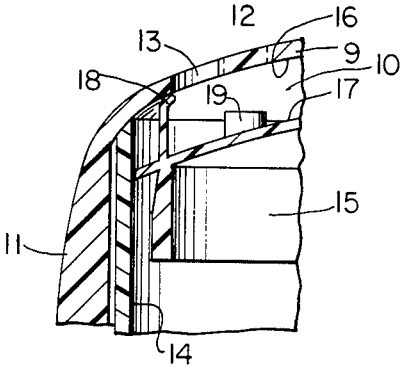
FIG. 3 is an enlarged fragmentary vertical cross-sectional view similar to FIG. 2 showing the fin starting to deform as it first encounters the underside of the applicating surface wall.

As the piston 15 approximates the underside 16 of the wall 9, the flexible fin 18 is the first part of the piston 15 to touchingly encounter the underside 16 of surface 12 as shown in FIG. 3. The fin 18 is offset from an orifice 13 so as to directly contact the underside 16 of the wall adjacent the aperture 13. The fin 18 should be resilient enough to deflect without breaking and without preventing further advance of the piston 15 throughout the remaining travel, until the piston reaches its uppermost position.

Figure 4:
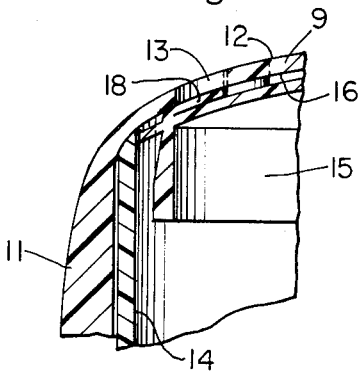
FIG. 4 is an enlarged fragmentary vertical cross-sectional view similar to FIGS. 2 and 3 showing the fin totally obscuring the orifice in the applicating surface wall as the piston reaches its uppermost position.

As the fin 18 is further deflected against the underside 16 of the wall 9 by further advance of piston 15, the fin 18 deflects towards the orifice, 13 as shown in FIG. 3 and moves thereacross. To best promote proper deflection of the fin 18, the axis of fin 18 on piston 15 and the underside 16 of wall 9 are placed in an angular relationship as shown in FIGS. 2 through 4 in which the lengthwise axis of the fin 18 is parallel to the sides of the container body 11, and forms an obtuse angle with respect to the underside 16 of the wall 9. The fin 18 is located in a position on the piston 15 such that the curved surface of underside 16 guides the tip of fin 18 toward the desired orifice 13. Alternatively, by employing wall 9 which has an underside 16 that is generally parallel to the top surface 17 of the piston 15 and a fin 18 that is formed curved in the direction of the desired orifice 13 from the outset, the angular relationship can be maintained. Another method to promote proper deflection of the fin 18 is to weaken it at a specific location near the base so that the fin 18 deflection is predisposed in the direction of the proper orifice 13.

The preferred cross section of the fin 18 is a high aspect ratio rectangle, to reduce rigidity and thereby encourage bending. When bent against the underside 16 of the applicating surface 12, the longer side of the rectangle conforms to the underside 16 of the wall 9.

As the piston 15 is further advanced, deflection of the deformable fin 18 will cause it to move laterally, progressively crossing the underside 16 of wall 9 and orifice 13. When the side of the fin 18 crosses the orifice 13 a sufficient distance, the lateral side of the fin 18 will become visible from the exterior of the dispenser when one looks into the orifice 13. To improve visibility of the fin 18, the side may be made of a color which contrasts with the background provided by the cream product. To further improve visibility it has been found that the fin should be close to the exterior side of the applicating surface 12. If the material forming the wall 9 is too thick, product in orifice 13 will cover the upper side of the fin 18 and obscure it from view. A wall 9 thickness of 0.51 mm (0.020 inches) or less has been found sufficient for use with a wide range of cream products when the product is applied to the resilient skin of the underarm.

If it is necessary that the wall 9 forming the applicating surface 12 be thicker for structural, aesthetic or other reasons as described above, the wall 9 may be locally thinned by providing a groove on the underside 16 adapted to deform the fin 18 and channel it towards the orifice 13. The groove provides a strategic reduction in the thickness of the wall 9 along the path of movement of fin 18, allowing the fin 18 to be closer to the applicating surface 12 and therefore visible to the user while moving in the lateral direction.

As shown in FIG. 4, the length of the fin 18 should be sufficient to totally obscure the orifice 13 when the product is depleted and the dispensing package is either to be disposed of or refilled. The width of the fin 18 should be at least equal to the diameter of the orifice 13 to provide the maximum contrast with the background that is otherwise visible when looking into the orifice and to preclude the fin 18 from protruding into the orifice 13.

If desired, the fin 18 could be designed such that after it crosses, and totally obscures, one orifice 13 the fin 18 could laterally progress towards a second orifice 13. As the piston 15 is advanced, the fin 18, after completely obscuring a first orifice will progress towards and begin to block an adjacently positioned second orifice. When the first orifice has been blocked, the user is alerted that the product is partially depleted. Blocking of the second orifice by the same fin 18 will further alert the user that the remaining product is very nearly depleted. The length of the fin 18 in that case should be at least as great as the distance between the outer edges of the two orifices. Using the same fin 18 to block one or more orifices provides staged indicia of the amount of product remaining. By observing the fin 18 as it progressivly blocks a given orifice, the user is able to more accurately judge the amount of product remaining in the dispenser.

To provide further indicia of the amount of product remaining, a plurality of fins 18 having one or more colors may be cantilevered from the piston surface 17. In the preferred embodiment, when the piston 15 is fully advanced to the underside 16 of wall 9 the fin 18 will have completely traversed the orifice 13.

An additional means to indicate the product has been totally dispensed is to provide short vertically extending nubs 19 on the top 17 of the piston 15. Preferentially, the nubs 19 are approximately equal in length to the thickness of the wall 9 and each is aligned directly under an orifice 13. When the piston surface 17 has closely approximated the underside 16 of the wall 9, the nub 19, being in alignment with an orifice 13, will project through the orifice 13 so that it can be seen from the outside of the package and thereby indicate the piston 15 has reached the end of its travel and that no product remains in the dispenser. A clearance of approximately 0.3 mm (0.022 inches) should be provided between the vertical sides of nub 19 and orifice 13.

If desired, the nub 19 can be incorporated into the side of a fin 18 as a lateral protrusion. When the fin 18 is laterally deformed, the nub 19 will extend towards the orifice 13 in the applicating surface. As the piston 15 is advanced, the nub 19 will progressivly block more of the orifice 13, until the fin 18 extends a sufficient distance across the orifice 13 to allow the nub 19 to protrude into the orifice 13, and signal the cream product is nearly depleted.

If the nub 19 is employed, extending either vertically from the elevator surface 17 or laterally from the side of the fin 19, it should preferentially be molded as a unit with the piston 15 or fin 18, so that separate attachment means are not required.

What is claimed is:

1. A dispensing package for cream products, said dispensing package comprising:

(a) a container body having an interior product chamber of generally uniform cross section and a longitudinal axis;

(b) a wall closing the outer end of the interior chamber and having an applicating surface formed thereon which has at least one orifice therein communicating with said interior product chamber;

(c) a piston having a cross section congruent to and mounted for axial movement within said chamber, said piston being nonrotable relative to the container body;

(d) means for causing axial advance of said piston; and (e) a flexible fin cantilevered outwardly from the piston, said fin being laterally offset from the orifice and adapted to be deflected so as to progressively move laterally across said orifice in response to axial advance of the piston as it approximates said wall, thereby providing an exteriorly visible signal that the cream product is nearly depleted.

2. A dispensing package according to claim 1 wherein the fin is adapted to be deflected by the inner surface of the wall adjacent said orifice.

3. A dispensing package according to claim 2 further comprising a groove located on the interior of the wall, said grove being adapted to channel the fin towards the orifice and to provide local thinning of the cross section of said wall, thereby allowing the fin to be closer to the applicating surface while moving laterally.

4. A dispensing package according to claims 1, 2 or 3 wherein the exterior of the fin comprises a color which contrasts with the color of the background formed by said cream product.

5. A dispensing package according to claims 1, 2 or 3 wherein said at least one orifice comprises a plurality of orifices and the flexible fin has an axial length at least equal to the distance between the outermost edges of adjacent orifices, enabling the fin to progressively obscure said adjacent orifices sequentially as the piston is advanced.

6. A dispensing package according to claims 1, 2 or 3 wherein the fin has a lateral protrusion on the side which faces the orifice as the fin approximates said wall, said protrusion being adapted to enter said orifice and thereby indicate the cream product is nearly depleted.

* * * * *

UNITED STATES PATENT OFFICE
CERTIFICATE OF CORRECTION

PATENT NO. : 4,782,983

DATED : November 8, 1988

INVENTOR(S) : Calvin S. Cook

It is certified that error appears in the above-identified patent and that said Letters Patent is hereby corrected as shown below:

Column 5, line 34, "elevator" should read -- piston --.

Column 5, line 35, "19, it" should read -- 18, nub 19 --.

Signed and Sealed this

Eighth Day of May, 1990

*Attest:*

HARRY F. MANBECK, JR.

*Attesting Officer*

*Commissioner of Patents and Trademarks*